US009605507B2

(12) United States Patent
Lovorn et al.

(10) Patent No.: US 9,605,507 B2
(45) Date of Patent: Mar. 28, 2017

(54) HIGH TEMPERATURE DRILLING WITH LOWER TEMPERATURE RATED TOOLS

(75) Inventors: James R. Lovorn, Tomball, TX (US); Derrick W. Lewis, Conroe, TX (US); Mohamed Sati, Katy, TX (US); Emad Bakri, Houston, TX (US); Clive D. Menezes, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 13/595,803

(22) Filed: Aug. 27, 2012

(65) Prior Publication Data

US 2013/0062122 A1 Mar. 14, 2013

Related U.S. Application Data

(60) Provisional application No. 61/532,512, filed on Sep. 8, 2011.

(51) Int. Cl.
*E21B 21/08* (2006.01)
*E21B 36/00* (2006.01)
(Continued)

(52) U.S. Cl.
CPC ..... *E21B 33/085* (2013.01); *E21B 21/08* (2013.01); *E21B 36/001* (2013.01); *E21B 47/065* (2013.01)

(58) Field of Classification Search
CPC ..... E21B 21/08; E21B 47/00; E21B 44/00; E21B 44/02; E21B 49/00; E21B 43/00;
(Continued)

(56) References Cited

U.S. PATENT DOCUMENTS 3,488,970 A 1/1970 Hallenburg
3,603,409 A 9/1971 Watkins
(Continued)

FOREIGN PATENT DOCUMENTS

EP 1432887 B1 3/2003
EP 1488073 B1 8/2003
(Continued)

OTHER PUBLICATIONS

US 6,708,780, 03/2004, Bourgoyne et al. (withdrawn)
(Continued)

*Primary Examiner* — Shane Bomar
*Assistant Examiner* — Wei Wang
(74) *Attorney, Agent, or Firm* — Chamberlain Hrdlicka

(57) ABSTRACT

A method of maintaining a desired temperature at a location in a well can include adjusting fluid circulation parameters, thereby reducing a difference between an actual temperature at the location and the desired temperature. A well system can include at least one sensor, an output of the sensor being used for determining a temperature at a location in a well, and a hydraulics model which determines a desired change in fluid circulation through the well, in response to the temperature at the location being different from a desired temperature at the location. Another method of maintaining a desired temperature at a location in a well can include adjusting a density, solids content and/or flow rate of a fluid circulated through the well, thereby urging a temperature at the location toward the desired temperature.

22 Claims, 3 Drawing Sheets

(51) Int. Cl.
*E21B 47/06* (2012.01)
*E21B 33/08* (2006.01)

(58) Field of Classification Search
CPC . E21B 47/10; E21B 7/00; E21B 36/00; E21B 47/06; E21B 36/001; E21B 47/065; E21B 33/085; G01V 11/00; G01V 3/38; C09K 8/58; C09K 8/588; C09K 8/02
USPC ..... 175/25, 38, 48; 703/10; 507/209, 270
See application file for complete search history.

(56) References Cited

U.S. PATENT DOCUMENTS 4,046,191 A 9/1977 Neath
4,063,602 A 12/1977 Howell et al.
4,099,583 A 7/1978 Maus
4,191,266 A 3/1980 van Eek et al.
4,194,567 A 3/1980 Marais
4,291,772 A 9/1981 Beynet
4,468,056 A 8/1984 Kramer et al.
4,626,135 A 12/1986 Roche
4,813,495 A 3/1989 Leach
4,880,060 A 11/1989 Schwendemann et al.
5,006,845 A 4/1991 Calcar
5,720,356 A 2/1998 Gardes
5,771,971 A 6/1998 Horton et al.
5,771,974 A 6/1998 Stewart et al.
6,053,252 A 4/2000 Edwards
6,065,550 A 5/2000 Gardes
6,102,673 A 8/2000 Mott et al.
6,138,774 A 10/2000 Bourgoyne, Jr. et al.
6,173,768 B1 1/2001 Watson
6,206,108 B1 * 3/2001 MacDonald et al. ..... 175/24
6,230,824 B1 5/2001 Peterman et al.
6,263,982 B1 7/2001 Hannegan et al.
6,273,193 B1 8/2001 Hermann et al.
6,325,159 B1 12/2001 Peterman et al.
6,328,107 B1 12/2001 Maus
6,450,262 B1 9/2002 Regan
6,454,022 B1 9/2002 Sangesland et al.
6,457,540 B2 10/2002 Gardes
6,470,975 B1 10/2002 Bourgoyne et al.
6,527,062 B2 3/2003 Elkins et al.
6,571,873 B2 6/2003 Maus
6,598,682 B2 7/2003 Johnson et al.
6,662,110 B1 12/2003 Bargach et al.
6,668,943 B1 12/2003 Maus et al.
6,732,798 B2 5/2004 Johnson et al.
6,732,804 B2 5/2004 Hosie et al.
6,739,397 B2 5/2004 Ayling
6,745,857 B2 6/2004 Gjedebo
6,802,379 B2 10/2004 Dawson et al.
6,814,140 B2 11/2004 Robichaux
6,820,702 B2 11/2004 Niedermayr et al.
6,840,322 B2 1/2005 Haynes et al.
6,854,532 B2 2/2005 Fincher et al.
6,892,812 B2 5/2005 Niedermayr et al.
6,904,981 B2 6/2005 Van Riet
6,913,092 B2 7/2005 Bourgoyne et al.
6,920,085 B2 7/2005 Finke et al.
6,981,561 B2 1/2006 Krueger et al.
7,023,691 B1 4/2006 Feight et al.
7,032,691 B2 4/2006 Humphreys
7,044,237 B2 5/2006 Leuchtenberg
7,055,627 B2 6/2006 Fontana et al.
7,073,591 B2 7/2006 Massie et al.
7,080,685 B2 7/2006 Bailey et al.
7,090,036 B2 8/2006 Deboer
7,093,662 B2 8/2006 De Boer
7,096,975 B2 8/2006 Aronstam et al.
7,114,571 B2 10/2006 Gatherar et al.
7,134,489 B2 11/2006 Van Riet
7,158,886 B2 1/2007 Hou et al.
7,159,669 B2 1/2007 Bourgoyne et al.
7,174,975 B2 2/2007 Krueger et al.
7,185,718 B2 3/2007 Gardes
7,185,719 B2 3/2007 Van Riet
7,201,231 B2 4/2007 Chaplin et al.
7,207,399 B2 4/2007 Duhe et al.
7,237,613 B2 7/2007 Radi et al.
7,237,623 B2 7/2007 Hannegan
7,258,171 B2 8/2007 Bourgoyne et al.
7,264,058 B2 9/2007 Fossli
7,270,185 B2 9/2007 Fontana et al.
7,278,496 B2 10/2007 Leuchtenberg
7,281,593 B2 10/2007 Steiner et al.
7,350,597 B2 4/2008 Reitsma et al.
7,353,887 B2 4/2008 Krueger et al.
7,367,410 B2 5/2008 Sangesland
7,367,411 B2 5/2008 Leuchtenberg
7,395,878 B2 7/2008 Reitsma et al.
7,444,242 B2 10/2008 Proett et al.
7,497,266 B2 3/2009 Fossli
7,513,310 B2 4/2009 Fossli
7,562,723 B2 * 7/2009 Reitsma ..... 175/72
7,610,251 B2 10/2009 Shayegi et al.
7,650,950 B2 1/2010 Leuchtenberg
7,658,228 B2 2/2010 Moksvold
7,677,329 B2 3/2010 Stave
7,708,064 B2 5/2010 Sehsah
7,721,822 B2 5/2010 Krueger et al.
7,806,203 B2 10/2010 Krueger et al.
7,913,774 B2 3/2011 Partouche
7,926,593 B2 4/2011 Bailey et al.
2002/0092655 A1 7/2002 Fincher et al.
2002/0108783 A1 8/2002 Elkins et al.
2002/0112888 A1 8/2002 Leuchtenberg
2003/0066650 A1 4/2003 Fontana et al.
2003/0089498 A1 5/2003 Johnson et al.
2003/0098181 A1 5/2003 Aronstam et al.
2003/0111799 A1 6/2003 Gilmore
2003/0127230 A1 7/2003 Von Eberstein, Jr. et al.
2003/0139916 A1 7/2003 Choe et al.
2003/0168258 A1 9/2003 Koederitz
2003/0170077 A1 9/2003 Herd et al.
2003/0220742 A1 11/2003 Niedermayr et al.
2004/0028476 A1 2/2004 Payne et al.
2004/0040746 A1 3/2004 Niedermayr et al.
2004/0124008 A1 7/2004 Fincher et al.
2004/0178001 A1 9/2004 Bourgoyne et al.
2004/0206548 A1 10/2004 Aronstam et al.
2005/0061546 A1 3/2005 Hannegan
2005/0092522 A1 5/2005 Humphreys
2005/0092523 A1 5/2005 McCaskill et al.
2005/0284659 A1 12/2005 Hall et al.
2006/0006004 A1 1/2006 Terry et al.
2006/0021755 A1 2/2006 Radi et al.
2006/0065402 A9 3/2006 Fontana et al.
2006/0070772 A1 4/2006 De Boer et al.
2006/0086538 A1 4/2006 Van Riet
2006/0102387 A1 5/2006 Bourgoyne et al.
2006/0124300 A1 6/2006 Steiner et al.
2006/0144619 A1 7/2006 Storm, Jr. et al.
2006/0169491 A1 8/2006 Fossli
2006/0185857 A1 8/2006 York et al.
2006/0191716 A1 8/2006 Humphreys
2006/0207795 A1 9/2006 Kinder et al.
2007/0068704 A1 3/2007 Krueger et al.
2007/0168056 A1 7/2007 Shayegi et al.
2007/0240875 A1 10/2007 Van Riet
2007/0278007 A1 12/2007 Krueger et al.
2008/0041149 A1 2/2008 Leuchtenberg
2008/0060846 A1 3/2008 Belcher et al.
2008/0105434 A1 5/2008 Orbell et al.
2008/0123470 A1 5/2008 Cooper et al.
2008/0210471 A1 9/2008 Bailey et al.
2008/0234939 A1 9/2008 Foot et al.
2008/0251257 A1 10/2008 Leuchtenberg
2009/0101351 A1 4/2009 Hannegan
2009/0101411 A1 4/2009 Hannegan et al.
2009/0139724 A1 6/2009 Gray et al.
2009/0145660 A1 6/2009 Johnson et al.
2009/0211239 A1 8/2009 Askeland
2009/0236144 A1 9/2009 Todd et al.

(56) References Cited

U.S. PATENT DOCUMENTS

| | | | | |
|---|---|---|---|---|
| 2010/0006297 | A1 | 1/2010 | Stave | |
| 2010/0018715 | A1 | 1/2010 | Orbell et al. | |
| 2010/0152070 | A1* | 6/2010 | Ghassemzadeh | 507/212 |
| 2010/0288507 | A1 | 11/2010 | Duhe et al. | |
| 2011/0048806 | A1 | 3/2011 | Fincher et al. | |
| 2011/0139506 | A1 | 6/2011 | Lovorn et al. | |
| 2011/0139509 | A1 | 6/2011 | Pool et al. | |
| 2011/0290562 | A1 | 12/2011 | Standifird et al. | |
| 2012/0155777 | A1 | 6/2012 | Schweiger et al. | |
| 2012/0242920 | A1 | 9/2012 | Xu et al. | |
| 2012/0251407 | A1 | 10/2012 | Petela et al. | |
| 2012/0292108 | A1 | 11/2012 | Lovorn et al. | |

FOREIGN PATENT DOCUMENTS

| | | | |
|---|---|---|---|
| EP | 1240404 | B1 | 12/2003 |
| EP | 1595057 | B1 | 9/2004 |
| EP | 1071862 | B1 | 11/2004 |
| EP | 1664478 | B1 | 2/2005 |
| EP | 1356186 | B1 | 6/2005 |
| EP | 2053196 | A1 | 4/2009 |
| GB | 2229787 | A | 10/1990 |
| WO | 9942696 | A1 | 8/1999 |
| WO | 01/65060 | A1 | 9/2001 |
| WO | 0183941 | A1 | 11/2001 |
| WO | 0190528 | A1 | 11/2001 |
| WO | 02/50398 | A1 | 6/2002 |
| WO | 0244518 | A1 | 6/2002 |
| WO | 03025334 | A8 | 3/2003 |
| WO | 03025336 | A1 | 3/2003 |
| WO | 03071091 | A9 | 8/2003 |
| WO | 2004005667 | A1 | 1/2004 |
| WO | 2004074627 | A1 | 9/2004 |
| WO | 2004085788 | A3 | 10/2004 |
| WO | 2005001237 | A1 | 1/2005 |
| WO | 2005017308 | A1 | 2/2005 |
| WO | 2005/042917 | A1 | 5/2005 |
| WO | 2005076803 | A2 | 8/2005 |
| WO | 2006029379 | A1 | 3/2006 |
| WO | 2006031119 | A1 | 3/2006 |
| WO | 2006099362 | A1 | 9/2006 |
| WO | 2006118920 | A3 | 11/2006 |
| WO | 2006138565 | A1 | 12/2006 |
| WO | 2007/008085 | A1 | 1/2007 |
| WO | 2007016000 | A1 | 2/2007 |
| WO | 2007030017 | A1 | 3/2007 |
| WO | 2007112292 | A3 | 4/2007 |
| WO | 2007081711 | A3 | 7/2007 |
| WO | 2007124330 | A3 | 11/2007 |
| WO | 2007126833 | A1 | 11/2007 |
| WO | 2008133523 | A1 | 11/2008 |
| WO | 2008134266 | A1 | 11/2008 |
| WO | 2008151128 | A9 | 12/2008 |
| WO | 2008156376 | A1 | 12/2008 |
| WO | 2009017418 | A1 | 2/2009 |
| WO | 2009018448 | A2 | 2/2009 |
| WO | 2009058706 | A2 | 5/2009 |
| WO | 2009086442 | A3 | 7/2009 |
| WO | 2009111412 | A1 | 9/2009 |
| WO | 2009123476 | A1 | 10/2009 |
| WO | 2010065646 | A3 | 6/2010 |
| WO | 2010071656 | A1 | 6/2010 |
| WO | 2010095947 | A1 | 8/2010 |
| WO | 2011043764 | A1 | 4/2011 |
| WO | 2012027245 | A1 | 3/2012 |

OTHER PUBLICATIONS

International Search Report with Written Opinion issued Feb. 8, 2012 for PCT Patent Application No. PCT/US11/031767, 9 pages.
Australian Office Action issued Oct. 5, 2010 for AU Patent Application No. 2007317276, 2 pages.
International Search Report with Written Opinion issued Oct. 13, 2010 for PCT Patent Application No. PCT/US10/020122, 13 pages.
International Search Report with Written Opinion issued Jan. 25, 2011 for PCT Patent Application No. PCT/US10/032578, 9 pages.
International Preliminary Report with Patentability issued Jun. 30, 2011 for PCT Patent Application No. PCT/US08/087686, 6 pages.
Office Action issued Sep. 16, 2011 for U.S. Appl. No. 12/299,411, 23 pages.
Office Action issued Nov. 25, 2011 for U.S. Appl. No. 13/084,841, 19 pages.
International Search Report with Written Opinion issued Dec. 13, 2011 for PCT Patent Application No. PCT/US11/035751, 16 pages.
International Search Report with Written Opinion issued Dec. 21, 2011 for PCT Patent Application No. PCT/US11/031790, 15 pages.
Search Report issued Jan. 29, 2013 for International Application No. PCT/US12/52559, 5 pages.
Written Opinion issued Jan. 29, 2013 for International Application No. PCT/US12/52559, 4 pages.
IRIS; "Automatic Coordination of Equipment while Circulating out a Kick and Displacing the Kill-Weight Mud", IADC Well Control Europe, dated 2010, 41 pages.
Office Action issued Mar. 14, 2012 for U.S. Appl. No. 12/299,411, 36 pages.
FAIPP Office Action issued Jul. 14, 2010 for U.S. Appl. No. 11/936,411, 16 pages.
PI Office Action issued Jul. 29, 2010 for U.S. Appl. No. 11/936,411, 3 pages.
Office Action issued Feb. 25, 2011 for U.S. Appl. No. 11/936,411, 66 pages.
Written Opinion issued May 17, 2010, for SG Patent Application Serial No. 2009030222, 2 pages.
GE Oil & Gas; "Hydril Pressure Control K Pulsation Dampers", product information, dated Aug. 6, 2010, 2 pages.
Chinese Office Action issued Feb. 22, 2012 for CN Patent Application No. 200780049409.0, 7 pages.
English Translation of Chinese Office Action issued Feb. 22, 2012 for CN Patent Application No. 200780049409.0, 7 pages.
Office Action issued Jan. 24, 2012 for U.S. Appl. No. 12/638,012, 18 pages.
Weatherford International Ltd.; "Weatherford Model 7800 Rotating Control Device", article No. 4593.00, dated 2007, 5 pages.
Weatherford International Ltd.; "Model 7875 Rotating Control Device", article No. 4594.01, dated 2010, 4 pages.
Hannegan, Don; Weatherford International; "Offshore Drilling Hazard Mitigation: Controlled Pressure Drilling Redefines What is Drillable", Managed Pressure Drilling Magazine, Drilling Contractor article, dated Jan.-Feb. 2009, 4 pages.
Smith Services; "Hold 2500 Rotating Control Device", product brochure, article No. ss-04-0055, dated 2004, 4 pages.
Smith Services; "Marine Riser RCD", product presentation, dated Jul. 2009, 18 pages.
Singapore Office Action issued Feb. 15, 2011 for SG Patent Application No. 200903022, 9 pages.
Australian Examiner's Report issued Mar. 7, 2011 for AU Patent Application No. 2007317276, 2 pages.
International Search Report and Written Opinion issued Jul. 27, 2011 for PCT Patent Application No. PCT/US2010/062394, 10 pages.
Singapore Examination Report issued Dec. 27, 2011 for SG Patent Application No. 200903022-2, 8 pages.
International Search Report and Written Opinion issued Feb. 12, 2009, for International Patent Application No. PCT/US08/87686, 7 pages.
International Search Report and Written Opinion issued Sep. 22, 2008, for International Patent Application No. PCT/US07/83974, 16 pages.
International Preliminary Report on Patentability issued May 22, 2009, for International Patent Application Serial No. PCT/US07/83974, 13 pages.
International Search Report with Written Opinion issued Jun. 17, 2011 for PCT Patent Application No. PCT/US10/056433, 9 pages.
International Search Report with Written Opinion issued Jul. 27, 2011 for PCT Patent Application No. PCT/US10/062394, 10 pages.
International Search Report with Written Opinion issued Nov. 21, 2011 for PCT Patent Application No. PCT/US11/036616, 13 pages.

(56) References Cited

OTHER PUBLICATIONS

Office Action issued Feb. 7, 2012 for U.S. Appl. No. 13/022,964, 15 pages.
Halliburton; "EAGLE™ Gas Extraction System", product overview, dated 2012, 1 page.
Halliburton; "Halliburton CPT-Y4™ Severe Environment Cementing Unit", article H05750, dated Jul. 2008, 2 pages.
Halliburton; "Mass Spectrometry Service for Gas Analysis", DQ1000 product overview, dated 2012, 1 page.
A Brovig/Halliburton Company; "MV Crystal Sea", specification and capabilities, received Nov. 25, 2011, 13 pages.
Synergy; "Synergy Wireline Trucks", featuring Halliburton wireline trucks, dated 2003, 34 pages.
Office Action issued Jun. 28, 2012 for U.S. Appl. No. 13/406,730, 22 pages.
Pre-Interview First Office Action issued Jul. 14, 2010 for U.S. Appl. No. 11/936,411, 14 pages.

* cited by examiner

HIGH TEMPERATURE DRILLING WITH LOWER TEMPERATURE RATED TOOLS

BACKGROUND

This disclosure relates generally to equipment utilized and operations performed in conjunction with a subterranean well and, in an example described below, more particularly provides for high temperature drilling with lower temperature rated tools.

As a wellbore is drilled deeper, higher temperatures are experienced by components of a drill string used to drill the wellbore. These components can include electronics, batteries, flow control devices, sensors, telemetry devices, motors, etc., which are rated for certain maximum temperatures in operation.

These maximum temperature ratings prohibit some components from being used in drilling operations where the ratings will be exceeded. Furthermore, higher temperature rated components (which are generally more expensive and less available) will need to be used if drilling operations are to proceed where higher temperatures are encountered.

BRIEF DESCRIPTION OF THE DRAWINGS

Various features, advantages and benefits will become apparent to one of ordinary skill in the art upon careful consideration of the detailed description of representative examples below and the accompanying drawings, in which similar elements are indicated in the various figures using the same reference numbers.

DETAILED DESCRIPTION

Temperature in a well can be affected by a wide variety of factors. Among these can be included: friction due to geometries of a drill string and a wellbore, friction between a drill bit and rock cut into by the drill bit, lower temperature circulating fluid, geothermal gradient, solids content of the circulating fluid, heat capacity of downhole components, flow rate of the circulating fluid, phase (or multiple phases) of the circulating fluid, type(s) of fluid present in the well, horsepower supplied to the drill bit, etc.

In the disclosure below, systems and methods are provided which bring improvements to the well drilling art. One example is described below in which a controlled pressure drilling system is used to reduce a temperature of a drill string component by reducing a density or solids content of fluid circulated through the drill string and/or by adjusting a flow rate of the fluid. Another example is described below in which a hydraulics model determines an annulus pressure set point for a reduced density fluid circulated through a bottom hole assembly, in order to reduce a temperature of the bottom hole assembly.

In some examples, fluid circulation parameters (such as, fluid density, solids content and/or flow rate) can be adjusted as needed to achieve and/or maintain a temperature at a particular location in a well. A hydraulics model can determine a desired fluid density, solids content and/or flow rate to achieve and/or maintain a desired temperature in the well.

In some examples, fluid friction can be adjusted as needed to achieve and/or maintain a temperature at a particular location in a well. The hydraulics model can determine a desired fluid friction to achieve and/or maintain a desired temperature in the well. In some examples, the hydraulics model can determine a temperature profile along the wellbore, including temperature changes due to changes in fluid friction, etc.

In some examples, the hydraulics model can also determine a desired annulus pressure set point to achieve a desired pressure at a particular location in a well. This can be useful in drilling systems where the annulus is closed off from the atmosphere (e.g., a closed fluid circulation system).

In some examples, the hydraulics model can also determine a desired fluid height to achieve a desired pressure at a particular location in a well. This can be useful in drilling systems where the annulus is open to atmosphere at the surface.

Figure 1:
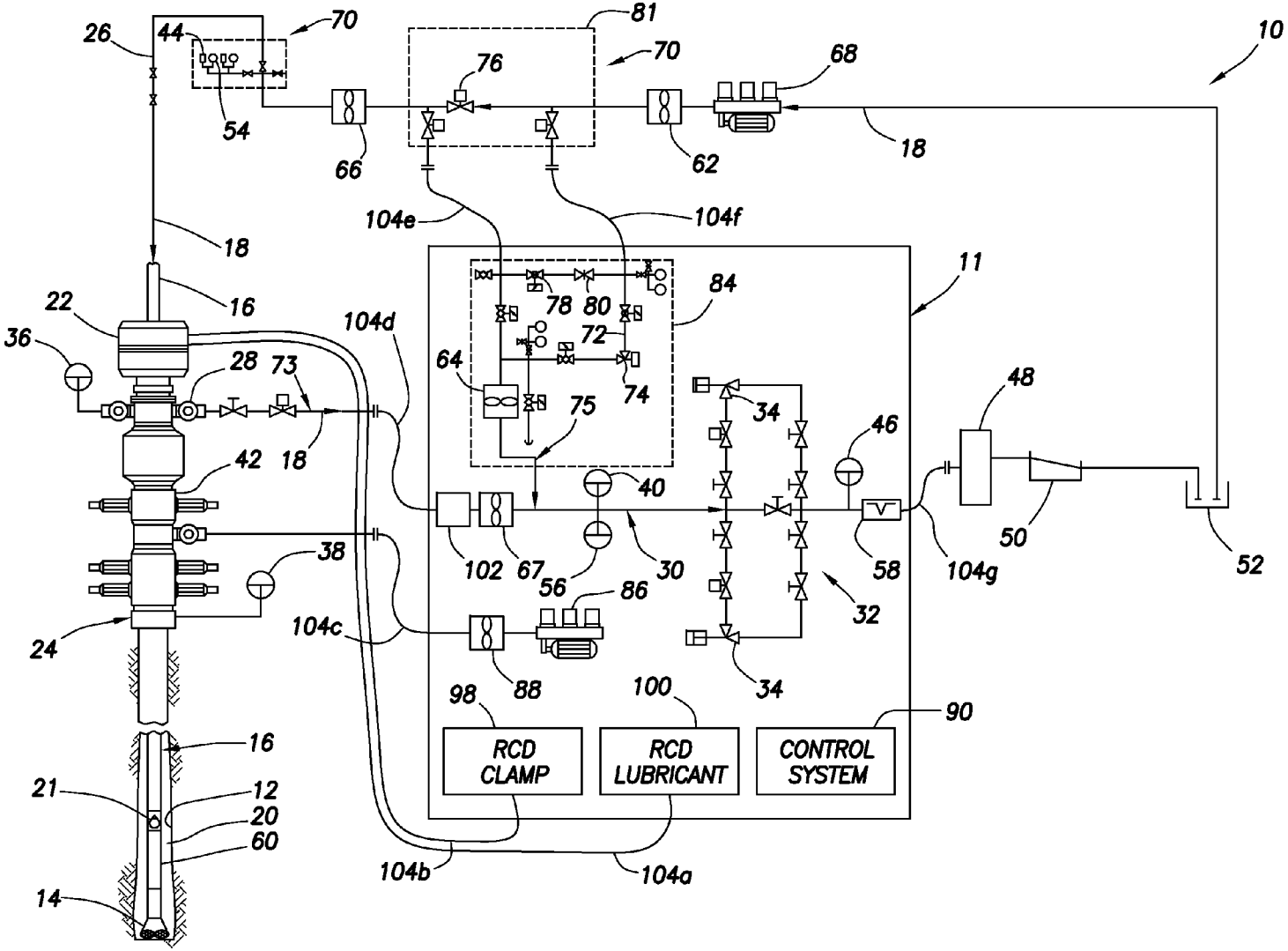
FIG. 1 is a schematic view of a well drilling system and method which can embody principles of this disclosure.

Representatively illustrated in FIG. 1 is a system 10 and associated method which can embody principles of this disclosure. However, it should be clearly understood that the system 10 and method are merely one example of an application of the principles of this disclosure in practice, and a wide variety of other examples are possible. Therefore, the scope of this disclosure is not limited at all to the details of the system 10 and method described herein and/or depicted in the drawings.

In the system 10, a wellbore 12 is drilled by rotating a drill bit 14 on an end of a drill string 16. Drilling fluid 18, commonly known as mud, is circulated downward through the drill string 16, out the drill bit 14 and upward through an annulus 20 formed between the drill string and the wellbore 12, in order to cool the drill bit, lubricate the drill string, remove cuttings and provide a measure of wellbore pressure control. A non-return valve 21 (typically a flapper or plunger-type check valve) prevents flow of the drilling fluid 18 upward through the drill string 16 (e.g., when connections are being made in the drill string).

Control of wellbore pressure is very important in controlled pressure drilling (e.g., managed pressure drilling, underbalanced drilling and overbalanced drilling). Preferably, the wellbore pressure is precisely controlled to prevent excessive loss of fluid into an earth formation surrounding the wellbore 12, undesired fracturing of the formation, excessive influx of formation fluids into the wellbore, etc.

In typical managed pressure drilling, it is desired to maintain bottom hole pressure somewhat greater than a pore pressure of the formation being penetrated by the wellbore 12, without exceeding a fracture pressure of the formation. This technique is especially useful in situations where the margin between pore pressure and fracture pressure is relatively small.

In typical underbalanced drilling, it is desired to maintain the bottom hole pressure somewhat less than the pore pressure of the formation, thereby obtaining a controlled influx of fluid from the formation. In typical overbalanced drilling, it is desired to maintain the bottom hole pressure somewhat greater than the pore pressure, thereby preventing (or at least mitigating) influx of fluid from the formation.

In managed pressure and underbalanced drilling, the wellbore is typically not open to the atmosphere at the surface. In overbalanced drilling, the wellbore may or may not be open to the atmosphere at the surface. This disclosure relates to either closed or open fluid circulation systems, but a managed pressure drilling operation is described more fully below, it being understood that the principles of this disclosure are equally applicable to other types of drilling operations.

Nitrogen or another gas, or another lighter weight fluid, may be added to the drilling fluid 18 for pressure control. This technique is useful, for example, in underbalanced drilling operations.

In the system 10, additional control over the wellbore pressure is obtained by closing off the annulus 20 (e.g., isolating it from communication with the atmosphere and enabling the annulus to be pressurized at or near the surface) using a rotating control device 22 (RCD). The RCD 22 seals about the drill string 16 above a wellhead 24. The drill string 16 extending upwardly through the RCD 22 would connect to, for example, a rotary table (not shown), a standpipe 26, a kelly (not shown), a top drive and/or other conventional drilling equipment.

In the example depicted in FIG. 1, a pressure management system 11 includes a choke manifold 32, a flow diverter 84 and a backpressure pump 86. Each of these is automatically controllable by a control system 90, in a manner more fully described below.

The pressure management system 11 may also include an RCD clamp control 98, an RCD lubricant supply 100 and a fluid analysis system 102. However, note that it is not necessary for the pressure management system 11 to include all of these elements. For example, it is contemplated that the pressure management system 11 will preferably include either the flow diverter 84 or the backpressure pump 86, but not both. Of course, the pressure management system 11 can include additional elements, and can be otherwise differently configured, in keeping with the scope of this disclosure.

The pressure management system 11 can be conveniently interconnected to a rig's drilling system using flexible lines 104*a-g*. Rigid lines may also (or alternatively) be used for this purpose, if desired.

During drilling, the drilling fluid 18 exits the wellhead 24 via a wing valve 28 in communication with the annulus 20 below the RCD 22. The fluid 18 then flows through mud return lines 30, 73 to the choke manifold 32, which includes redundant chokes 34 (only one of which might be used at a time). Backpressure is applied to the annulus 20 by variably restricting flow of the fluid 18 through the operative choke (s) 34.

The greater the restriction to flow through the choke 34, the greater the backpressure applied to the annulus 20. Thus, downhole pressure (e.g., pressure at the bottom of the wellbore 12, pressure at a downhole casing shoe, pressure at a particular formation or zone, etc.) can be conveniently regulated by varying the backpressure applied to the annulus 20.

A hydraulics model can be used, as described more fully below, to determine a pressure applied to the annulus 20 at or near the surface which will result in a desired downhole pressure, so that an operator (or an automated control system) can readily determine how to regulate the pressure applied to the annulus at or near the surface (which can be conveniently measured) in order to obtain the desired downhole pressure.

Pressure applied to the annulus 20 can be measured at or near the surface via a variety of pressure sensors 36, 38, 40, each of which is in communication with the annulus. Pressure sensor 36 senses pressure below the RCD 22, but above a blowout preventer (BOP) stack 42. Pressure sensor 38 senses pressure in the wellhead below the BOP stack 42. Pressure sensor 40 senses pressure in the mud return lines 30, 73 upstream of the choke manifold 32.

Another pressure sensor 44 senses pressure in the standpipe 26. Yet another pressure sensor 46 senses pressure downstream of the choke manifold 32, but upstream of a separator 48, shaker 50 and mud pit 52. Additional sensors include temperature sensors 54, 56, Coriolis flowmeter 58, and flowmeters 62, 64, 66, 88.

Not all of these sensors are necessary. For example, the system 10 could include only two of the three flowmeters 62, 64, 66. However, input from all available sensors is useful to the hydraulics model in determining what the pressure applied to the annulus 20 should be during the drilling operation.

Other sensor types may be used, if desired. For example, it is not necessary for the flowmeter 58 to be a Coriolis flowmeter, since a turbine flowmeter, acoustic flowmeter, or another type of flowmeter could be used instead.

In addition, the drill string 16 may include its own sensors 60, for example, to directly measure downhole pressure. Such sensors 60 may be of the type known to those skilled in the art as pressure while drilling (PWD), measurement while drilling (MWD) and/or logging while drilling (LWD). These drill string sensor systems generally provide at least pressure measurement, and may also provide temperature measurement, detection of drill string characteristics (such as vibration, weight on bit, stick-slip, etc.), formation characteristics (such as resistivity, density, etc.) and/or other measurements.

Various forms of wired or wireless telemetry (acoustic, pressure pulse, electromagnetic, etc.) may be used to transmit the downhole sensor measurements to the surface. For example, the drill string 16 could have lines (e.g., optical, electrical or hydraulic lines, etc.) extending interiorly, exteriorly or in a wall of the drill string.

The sensors 60 and other components (such as, a mud motor, a telemetry device, etc.) of the drill string 16 connected near the drill bit 14 are collectively known to those skilled in the art as a bottom hole assembly. A particular bottom hole assembly generally cannot be used for drilling where the temperature at the bottom hole assembly exceeds a maximum temperature rating of any of its components.

Additional sensors could be included in the system 10, if desired. For example, another flowmeter 67 could be used to measure the rate of flow of the fluid 18 exiting the wellhead 24, another Coriolis flowmeter (not shown) could be interconnected directly upstream or downstream of a rig mud pump 68, etc.

Fewer sensors could be included in the system 10, if desired. For example, the output of the rig mud pump 68 could be determined by counting pump strokes, instead of by using the flowmeter 62 or any other flowmeter(s).

Note that the separator 48 could be a 3 or 4 phase separator, or a mud gas separator (sometimes referred to as a "poor boy degasser"). However, the separator 48 is not necessarily used in the system 10.

The drilling fluid 18 is pumped through the standpipe 26 and into the interior of the drill string 16 by the rig mud pump 68. The pump 68 receives the fluid 18 from the mud pit 52 and flows it via a standpipe manifold 70 to the standpipe 26. The fluid 18 then circulates downward through the drill string 16, upward through the annulus 20, through the mud return lines 30, 73, through the choke manifold 32, and then via the separator 48 and shaker 50 to the mud pit 52 for conditioning and recirculation.

Note that, in the system 10 as so far described above, the choke 34 cannot be used to control backpressure applied to the annulus 20 for control of the downhole pressure, unless the fluid 18 is flowing through the choke. In conventional overbalanced drilling operations, a lack of fluid 18 flow will occur, for example, whenever a connection is made in the drill string 16 (e.g., to add another length of drill pipe to the drill string as the wellbore 12 is drilled deeper), and the lack of circulation will require that downhole pressure be regulated solely by the density of the fluid 18.

In the system 10, however, flow of the fluid 18 through the choke 34 can be maintained, even though the fluid does not circulate through the drill string 16 and annulus 20, while a connection is being made in the drill string, and/or while the drill string is being tripped into or out of the wellbore 12. Specifically, a flow diverter 84 may be used to divert flow from the rig mud pump 68 to the mud return line 30, or a backpressure pump 86 may be used to supply flow through the choke manifold 32, and thereby enable precise control over pressure in the wellbore 12. Thus, pressure can still be applied to the annulus 20 by restricting flow of the fluid 18 through the choke 34, even while the fluid does not circulate through the drill string 16.

The fluid 18 can be flowed from the rig mud pump 68 to the choke manifold 32 via a bypass line 72, 75 when fluid 18 does not flow through the drill string 16. Thus, the fluid 18 can bypass the standpipe 26, drill string 16 and annulus 20, and can flow directly from the pump 68 to the mud return line 30, which remains in communication with the annulus 20. Restriction of this flow by the choke 34 will thereby cause pressure to be applied to the annulus 20 (for example, in typical managed pressure drilling).

Alternatively, the fluid 18 can be flowed from the backpressure pump 86 to the annulus 20 and, since the annulus is connected to the choke manifold 32 via the return line 73, 30, this will supply flow through the choke 34, so that wellbore pressure can be controlled by variably restricting the flow through the choke.

As depicted in FIG. 1, both of the bypass line 75 and the mud return line 30 are in communication with the annulus 20 via a single line 73. However, the bypass line 75 and the mud return line 30 could instead be separately connected to the wellhead 24, for example, using an additional wing valve (e.g., below the RCD 22), in which case each of the lines 30, 75 would be directly in communication with the annulus 20.

Although this might require some additional piping at the rig site, the effect on the annulus pressure would be similar to connecting the bypass line 75 and the mud return line 30 to the common line 73. Thus, it should be appreciated that various different configurations of the components of the system 10 may be used, without departing from the principles of this disclosure.

Flow of the fluid 18 through the bypass line 72, 75 is regulated by a choke or other type of flow control device 74. Line 72 is upstream of the bypass flow control device 74, and line 75 is downstream of the bypass flow control device.

Flow of the fluid 18 through the standpipe 26 is substantially controlled by a valve or other type of flow control device 76. Note that the flow control devices 74, 76 are preferably independently controllable.

Since the rate of flow of the fluid 18 through each of the standpipe 26 and bypass line 72 is useful data in determining how bottom hole pressure is affected by these flows, the flowmeters 64, 66 are depicted in FIG. 1 as being interconnected in these lines. However, the rate of flow through the standpipe 26 could be determined even if only the flowmeters 62, 64 were used, and the rate of flow through the bypass line 72 could be determined even if only the flowmeters 62, 66 were used. Thus, it should be understood that it is not necessary for the system 10 to include all of the sensors depicted in FIG. 1 and described herein, and the system could instead include additional sensors, different combinations and/or types of sensors, etc.

A bypass flow control device 78 and flow restrictor 80 may be used for filling the standpipe 26 and drill string 16 after a connection is made in the drill string, and for equalizing pressure between the standpipe and mud return lines 30, 73 prior to opening the flow control device 76. Otherwise, sudden opening of the flow control device 76 prior to the standpipe line 26 and drill string 16 being filled and pressurized with the fluid 18 could cause an undesirable pressure transient in the annulus 20 (e.g., due to flow to the choke manifold 32 temporarily being lost while the standpipe and drill string fill with fluid, etc.).

By opening the standpipe bypass flow control device 78 after a connection is made, the fluid 18 is permitted to fill the standpipe 26 and drill string 16 while a substantial majority of the fluid continues to flow through the bypass line 72, thereby enabling continued controlled application of pressure to the annulus 20. After the pressure in the standpipe 26 has equalized with the pressure in the mud return lines 30, 73 and bypass line 75, the flow control device 76 can be opened, and then the flow control device 74 can be closed to slowly divert a greater proportion of the fluid 18 from the bypass line 72 to the standpipe 26.

Before a connection is made in the drill string 16, a similar process can be performed, except in reverse, to gradually divert flow of the fluid 18 from the standpipe 26 to the bypass line 72 in preparation for adding more drill pipe to the drill string 16. That is, the flow control device 74 can be gradually opened to slowly divert a greater proportion of the fluid 18 from the standpipe 26 to the bypass line 72, and then the flow control device 76 can be closed.

Note that the flow control device 78 and flow restrictor 80 could be integrated into a single element (e.g., a flow control device having a flow restriction therein), if desired. The flow control device 76 can be part of a flow diversion manifold 81 interconnected between the rig mud pump 68 and the rig standpipe manifold 70.

The RCD clamp control 98 is used to remotely operate a clamp (not visible in FIG. 1) of the RCD 22. The clamp is for permitting access to a seal and a bearing assembly of the RCD 22. Examples of electrical and hydraulic remote control of RCD clamps are described in International Application No. PCT/US11/28384, filed 14 Mar. 2011, and in International Application No. PCT/US10/57540, filed 20 Nov. 2010. If a hydraulically operated RCD clamp is used, hydraulic pressure may be supplied to the RCD clamp control 98 from a conveyance (e.g., vehicle, vessel, etc.) which transports the pressure management system 11 to the rig site.

The fluid analysis system 102 is used to determine properties of the fluid 18 which flows from the annulus 20 to the pressure management system 11. The fluid analysis system 102 may include, for example, a gas analyzer which extracts gas from the fluid 18 and determines its composition, a gas spectrometer, a densitometer, a flowmeter, etc. The gas analyzer may be similar to an EAGLE™ gas extraction system and a DQ1000™ mass spectrometer marketed by Halliburton Energy Services, Inc.

The fluid analysis system 102 may include a real time rheology analyzer, which continuously monitors rheological properties of the fluid 18 and transmits this data to the hydraulics model 92. A suitable rheology analyzer for use in the fluid analysis system 102 is described in U.S. Application No. 61/377,164, filed 26 Aug. 2010.

Figure 1A:
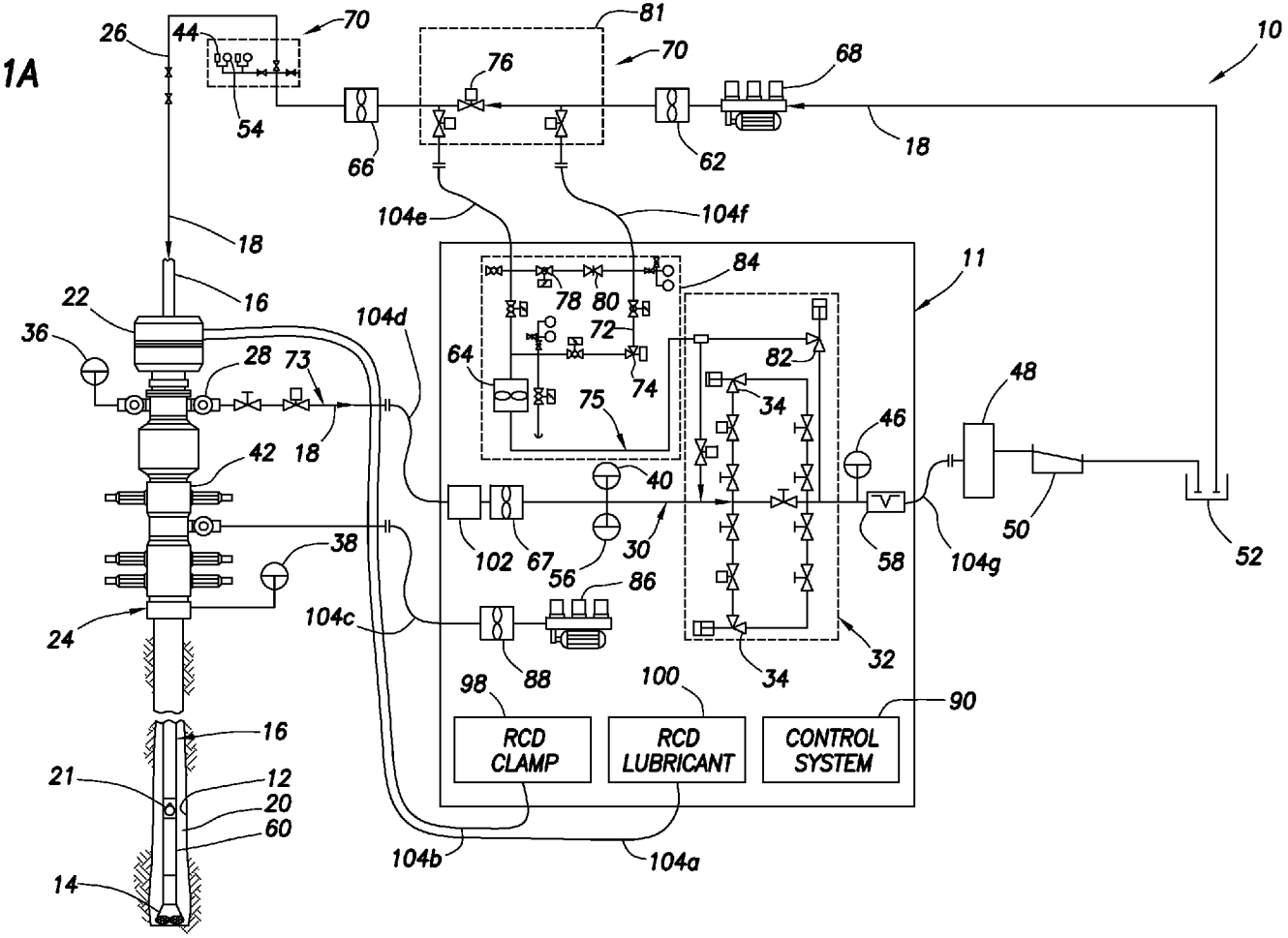
FIG. 1A is a schematic view of another configuration of the well drilling system.

Referring additionally now to FIG. 1A, a somewhat different configuration of the system 10 is representatively illustrated. In this configuration, the bypass line 75 is connected to a third choke 82. The bypass line 75 remains connected to the return line 30 also, but the choke 82 provides for convenient regulation of the amount of fluid 18 discharged from the flow diverter 84.

Thus, when resistance to flow through the choke 82 is increased, more of the fluid 18 flows to the mud return line 30. When resistance to flow through the choke 82 is decreased, more of the fluid 18 flows to a downstream side of the choke manifold 32 (and not through the chokes 34).

Figure 2:
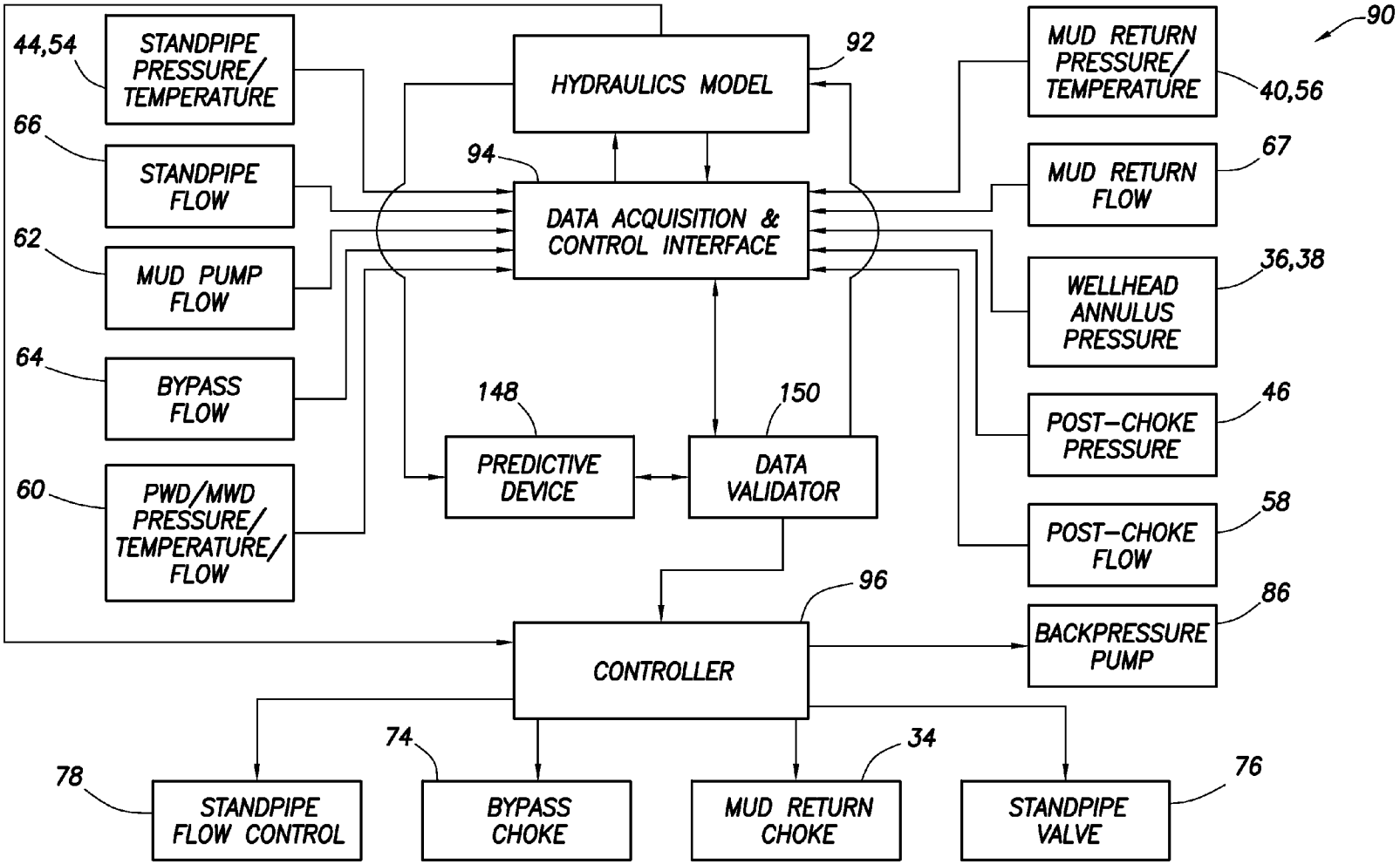
FIG. 2 is a schematic block diagram of a pressure and flow control system which may be used with the well drilling system and method.

A pressure and flow control system 90 which may be used in conjunction with the system 10 and associated method of FIGS. 1 & 1A is representatively illustrated in FIG. 2. The control system 90 is preferably fully automated, although some human intervention may be used, for example, to safeguard against improper operation, initiate certain routines, update parameters, etc.

The control system 90 includes a hydraulics model 92, a data acquisition and control interface 94 and a controller 96 (such as a programmable logic controller or PLC, a suitably programmed computer, etc.). Although these elements 92, 94, 96 are depicted separately in FIG. 2, any or all of them could be combined into a single element, or the functions of the elements could be separated into additional elements, other additional elements and/or functions could be provided, etc.

The hydraulics model 92 is used in the control system 90 to determine the desired annulus pressure at or near the surface to achieve the desired downhole pressure. Data such as well geometry, fluid properties and offset well information (such as geothermal gradient and pore pressure gradient, etc.) are utilized by the hydraulics model 92 in making this determination, as well as real-time sensor data acquired by the data acquisition and control interface 94.

Thus, there is a continual two-way transfer of data and information between the hydraulics model 92 and the data acquisition and control interface 94. The data acquisition and control interface 94 operates to maintain a substantially continuous flow of real-time data from the sensors 44, 54, 66, 62, 64, 60, 58, 46, 36, 38, 40, 56, 67, 88 and fluid analysis system 102 to the hydraulics model 92, so that the hydraulics model has the information it needs to adapt to changing circumstances and to update the desired annulus pressure. The hydraulics model 92 operates to supply the data acquisition and control interface 94 substantially continuously with a value for the desired annulus 20 pressure.

A suitable hydraulics model for use as the hydraulics model 92 in the control system 90 is REAL TIME HYDRAULICS™ provided by Halliburton Energy Services, Inc. of Houston, Tex. USA. Another suitable hydraulics model is provided under the trade name IRIS™, and yet another is available from SINTEF of Trondheim, Norway. Any suitable hydraulics model may be used in the control system 90 in keeping with the principles of this disclosure.

A suitable data acquisition and control interface for use as the data acquisition and control interface 94 in the control system 90 are SENTRY™ and INSITE™ provided by Halliburton Energy Services, Inc. Any suitable data acquisition and control interface may be used in the control system 90 in keeping with the principles of this disclosure.

The controller 96 operates to maintain a desired setpoint annulus pressure, in part by controlling operation of the mud return choke 34. When an updated desired annulus pressure is transmitted from the data acquisition and control interface 94 to the controller 96, the controller uses the desired annulus pressure as a setpoint and controls operation of the choke 34 in a manner (e.g., increasing or decreasing flow resistance through the choke as needed) to maintain the setpoint pressure in the annulus 20. The choke 34 can be closed more to increase flow resistance, or opened more to decrease flow resistance.

Maintenance of the setpoint pressure can be accomplished by comparing the setpoint pressure to a measured annulus pressure (such as the pressure sensed by any of the sensors 36, 38, 40), and decreasing flow resistance through the choke 34 if the measured pressure is greater than the setpoint pressure, and increasing flow resistance through the choke if the measured pressure is less than the setpoint pressure. Of course, if the setpoint and measured pressures are the same, then no adjustment of the choke 34 is required. This process is preferably automated, so that no human intervention is required, although human intervention may be used, if desired.

The controller 96 may also be used to control operation of the standpipe flow control devices 76, 78 and the bypass flow control device 74. The controller 96 can, thus, be used to automate the processes of diverting flow of the fluid 18 from the standpipe 26 to the bypass line 72 prior to making a connection in the drill string 16, then diverting flow from the bypass line to the standpipe after the connection is made, and then resuming normal circulation of the fluid 18 for drilling. Again, no human intervention may be required in these automated processes, although human intervention may be used if desired, for example, to initiate each process in turn, to manually operate a component of the system, etc.

The control system 90 also preferably includes a predictive device 148 and a data validator 150. The predictive device 148 preferably comprises one or more neural network models for predicting various well parameters. These parameters could include outputs of any of the sensors 36, 38, 40, 44, 46, 54, 56, 58, 60, 62, 64, 66, 67, 88, 102, the annulus pressure setpoint output from the hydraulics model 92, positions of flow control devices 34, 74, 76, 78, drilling fluid 18 density, etc. Any well parameter, and any combination of well parameters, may be predicted by the predictive device 148.

The predictive device 148 is preferably "trained" by inputting present and past actual values for the parameters to the predictive device. Terms or "weights" in the predictive device 148 may be adjusted based on derivatives of output of the predictive device with respect to the terms.

The predictive device 148 may be trained by inputting to the predictive device data obtained during drilling, while making connections in the drill string 16, and/or during other stages of an overall drilling operation. The predictive device 148 may be trained by inputting to the predictive device data obtained while drilling at least one prior wellbore.

The training may include inputting to the predictive device 148 data indicative of past errors in predictions produced by the predictive device. The predictive device 148 may be trained by inputting data generated by a computer simulation of the well drilling system 10 (including the drilling rig, the well, equipment utilized, etc.).

Once trained, the predictive device 148 can accurately predict or estimate what value one or more parameters should have in the present and/or future. The predicted parameter values can be supplied to the data validator 150 for use in its data validation processes.

The predictive device 148 does not necessarily comprise one or more neural network models. Other types of predictive devices which may be used include an artificial intelligence device, an adaptive model, a nonlinear function which generalizes for real systems, a genetic algorithm, a linear system model, and/or a nonlinear system model, combinations of these, etc.

The predictive device 148 may perform a regression analysis, perform regression on a nonlinear function and may utilize granular computing. An output of a first principle model may be input to the predictive device 148 and/or a first principle model may be included in the predictive device.

The predictive device 148 receives the actual parameter values from the data validator 150, which can include one or more digital programmable processors, memory, etc. The data validator 150 uses various pre-programmed algorithms to determine whether sensor measurements, flow control device positions, etc., received from the data acquisition & control interface 94 are valid.

For example, if a received actual parameter value is outside of an acceptable range, unavailable (e.g., due to a non-functioning sensor) or differs by more than a predetermined maximum amount from a predicted value for that parameter (e.g., due to a malfunctioning sensor), then the data validator 150 may flag that actual parameter value as being "invalid." Invalid parameter values may not be used for training the predictive device 148, or for determining the desired annulus pressure setpoint by the hydraulics model 92. Valid parameter values would be used for training the predictive device 148, for updating the hydraulics model 92, for recording to the data acquisition & control interface 94 database and, in the case of the desired annulus pressure setpoint, transmitted to the controller 96 for controlling operation of the flow control devices 34, 74, 76, 78.

The desired annulus pressure setpoint may be communicated from the hydraulics model 92 to each of the data acquisition & control interface 94, the predictive device 148 and the controller 96. The desired annulus pressure setpoint is communicated from the hydraulics model 92 to the data acquisition & control interface 94 for recording in its database, and for relaying to the data validator 150 with the other actual parameter values.

The desired annulus pressure setpoint is communicated from the hydraulics model 92 to the predictive device 148 for use in predicting future annulus pressure setpoints. However, the predictive device 148 could receive the desired annulus pressure setpoint (along with the other actual parameter values) from the data validator 150 in other examples.

The desired annulus pressure setpoint is communicated from the hydraulics model 92 to the controller 96 for use in case the data acquisition & control interface 94 or data validator 150 malfunctions, or output from these other devices is otherwise unavailable. In that circumstance, the controller 96 could continue to control operation of the various flow control devices 34, 74, 76, 78 to maintain/achieve the desired pressure in the annulus 20 near the surface.

The predictive device 148 is trained in real time, and is capable of predicting current values of one or more sensor measurements based on the outputs of at least some of the other sensors. Thus, if a sensor output becomes unavailable, the predictive device 148 can supply the missing sensor measurement values to the data validator 150, at least temporarily, until the sensor output again becomes available.

If, for example, during the drill string connection process described above, one of the flowmeters 62, 64, 66 malfunctions, or its output is otherwise unavailable or invalid, then the data validator 150 can substitute the predicted flowmeter output for the actual (or nonexistent) flowmeter output. It is contemplated that, in actual practice, only one or two of the flowmeters 62, 64, 66 may be used. Thus, if the data validator 150 ceases to receive valid output from one of those flowmeters, determination of the proportions of fluid 18 flowing through the standpipe 26 and bypass line 72 could not be readily accomplished, if not for the predicted parameter values output by the predictive device 148. It will be appreciated that measurements of the proportions of fluid 18 flowing through the standpipe 26 and bypass line 72 are very useful, for example, in calculating equivalent circulating density and/or friction pressure by the hydraulics model 92 during the drill string connection process.

Validated parameter values are communicated from the data validator 150 to the hydraulics model 92 and to the controller 96. The hydraulics model 92 utilizes the validated parameter values, and possibly other data streams, to compute the pressure currently present downhole at the point of interest (e.g., at the bottom of the wellbore 12, at a problematic zone, at a casing shoe, etc.), and the desired pressure in the annulus 20 near the surface needed to achieve a desired downhole pressure.

The data validator 150 is programmed to examine the individual parameter values received from the data acquisition & control interface 94 and determine if each falls into a predetermined range of expected values. If the data validator 150 detects that one or more parameter values it received from the data acquisition & control interface 94 is invalid, it may send a signal to the predictive device 148 to stop training the neural network model for the faulty sensor, and to stop training the other models which rely upon parameter values from the faulty sensor to train.

Although the predictive device 148 may stop training one or more neural network models when a sensor fails, it can continue to generate predictions for output of the faulty sensor or sensors based on other, still functioning sensor inputs to the predictive device. Upon identification of a faulty sensor, the data validator 150 can substitute the predicted sensor parameter values from the predictive device 148 to the controller 96 and the hydraulics model 92. Additionally, when the data validator 150 determines that a sensor is malfunctioning or its output is unavailable, the data validator can generate an alarm and/or post a warning, identifying the malfunctioning sensor, so that an operator can take corrective action.

The predictive device 148 is preferably also able to train a neural network model representing the output of the hydraulics model 92. A predicted value for the desired annulus pressure setpoint is communicated to the data validator 150. If the hydraulics model 92 has difficulties in generating proper values or is unavailable, the data validator 150 can substitute the predicted desired annulus pressure setpoint to the controller 96.

It will be appreciated from the above descriptions of the pressure management system 11, and the pressure and flow control system 90, that if a density of the fluid 18 circulated through the drill string 16 and annulus 20 is decreased, then hydrostatic pressure in the wellbore 12 will also decrease. To prevent pressure in the wellbore 12 from unacceptably decreasing due to the reduced hydrostatic pressure, the hydraulics model 92 will (depending on the particular circumstances) increase the annulus 20 pressure set point. Thus, the hydraulics model 92 can readily determine how pressures and flows should be adjusted to compensate for changes in the density of the fluid 18.

The present inventors have conceived that the hydraulics model 92 can also be used for controlling well pressure when the density of the fluid 18 is reduced, in order to decrease a temperature of the bottom hole assembly (or to maintain a reduced temperature of the bottom hole assembly).

When the density of the fluid 18 is reduced, less friction is generated while the fluid flows through the drill string 16 and wellbore 12. The sensors 60 of the bottom hole assembly can measure its temperature, and the fluid 18 density can be reduced as needed to achieve or maintain a temperature of the bottom hole assembly which is substantially less than a temperature of its surrounding well environment.

Solids content of the fluid 18 is indirectly related to the fluid's density. Everything else being equal, the fluid 18 density will increase as its solids content increases, but if a density of a liquid portion of the fluid 18 decreases, the density of the fluid could decrease, even if its solids content increases. Increased solids content can result from less efficient hole cleaning (e.g., due to increased drill cuttings in the fluid), and so increased flow rate can result in reduced solids content.

Increased solids content can cause increased fluid friction, thereby increasing downhole temperatures. Conversely, by reducing solids content, downhole temperatures can be reduced.

The hydraulics model 92 can be provided with the information as to the fluid 18 density and/or solids content and, during drilling operations, the annulus 20 pressure set point will be adjusted as needed to achieve and maintain a desired well pressure. It is conceived that a desired temperature could be achieved and maintained at any particular location in a well, by adjusting the fluid 18 density and/or solids content. Simultaneously, the hydraulics model 92 can adjust the annulus 20 pressure set point as needed to achieve and maintain a desired pressure at any location in the well.

When the flow rate of the fluid 18 is increased, fluid friction can increase, but in most circumstances this is more than offset by the presence of the lower temperature circulated fluid as the fluid flows through the drill string 16 and wellbore 12. The circulated fluid 18 effectively removes heat from the wellbore 12. The sensors 60 of the bottom hole assembly can measure its temperature, and the fluid 18 flow rate can be increased as needed to achieve or maintain a temperature of the bottom hole assembly which is substantially less than a temperature of its surrounding well environment.

The hydraulics model 92 can be provided with the information as to the fluid 18 flow rate and, during drilling operations, the annulus 20 pressure set point will be adjusted as needed to achieve and maintain a desired well pressure. Thus, it is conceived that a desired temperature could be achieved and maintained at any particular location in a well, by adjusting the fluid 18 density, solids content and flow rate through the drill string 16 and wellbore 12. Simultaneously, the hydraulics model 92 can adjust the annulus 20 pressure set point as needed to achieve and maintain a desired pressure at any location in the well.

The hydraulics model 92 is also provided with temperature data from the downhole sensors 60 and various surface sensors 54, 56, etc. Accordingly, the hydraulics model 92 can compare the desired temperature at any particular location in the well with a temperature at that location measured by the sensors 54, 56, 60, etc. (or inferred from those sensors' measurements), and the hydraulics model can determine whether the temperature at that location should be increased, decreased, or remain the same.

Thus, the hydraulics model 92 can be used to determine whether the fluid 18 density, solids content and/or flow rate should be increased, decreased or maintained the same, as needed to increase, decrease or maintain, respectively, the temperature at a particular well location. As the fluid 18 density, solids content and/or flow rate is changed or maintained, the hydraulics model 92 can also determine the appropriate annulus 20 pressure set point, as needed to achieve and maintain a desired pressure at any location in the well.

Being able to adjust the temperature of the bottom hole assembly allows it to be used in well environments having temperatures which would otherwise exceed a maximum temperature rating of one or more of the bottom hole assembly components. This makes more bottom hole assemblies, and less expensive bottom hole assemblies, available for use in high temperature drilling environments.

The hydraulics model can determine a temperature profile along the wellbore (e.g., in the annulus 20) based on all factors: fluid density, solids content, flow rate, geothermal profile, fluid types, casing, flow from or to the formation surrounding the wellbore, heat generated by fluid friction, rate of penetration, torque, inclination, wellbore geometry, different fluid types (oil, water, gas, etc.), and other drilling parameters.

If the annulus 20 is open to the atmosphere at the surface, or if the fluid 18 does not completely fill the annulus, or if a dual gradient system is used, the principles of this disclosure are still applicable. For example, the hydraulics model 92 can determine what the height of the fluid 18 column should be (or what the height of a reduced density fluid column in a dual gradient system should be), in order to achieve a desired pressure at a particular location in the well. This can be accomplished along with the temperature reduction caused by reducing the density of the fluid 18 or otherwise reducing fluid friction in the well, increasing the flow rate of the fluid, etc.

It can now be fully appreciated that the above disclosure provides significant advancements to the art. In one example described above, a method of maintaining a desired temperature at a location in a well can comprise adjusting fluid 18 circulation parameters (e.g., fluid density, solids content, flow rate, fluid friction, etc.), thereby urging a temperature at the location toward the desired temperature.

The above disclosure provides to the art a method of maintaining a desired temperature at a location in a well being drilled. In one example, the method can comprise: measuring an actual temperature at the location; and adjusting a fluid 18 flow rate in the well, so that the actual temperature substantially equals the desired temperature at the location.

The adjusting step can include changing the fluid 18 flow rate, thereby reducing a difference between the desired temperature and the actual temperature at the location.

The adjusting step can include increasing the fluid 18 flow rate, thereby reducing the actual temperature at the location.

The method can include a hydraulics model 92 determining a change in the fluid 18 flow rate to reduce a difference between the desired temperature and the actual temperature at the location.

The hydraulics model 92 may determine a desired pressure set point after the adjusting.

The hydraulics model 92 may determine a desired annulus pressure set point to achieve a desired pressure in the well.

The hydraulics model 92 may determine a desired fluid 18 height to achieve a desired pressure in the well.

The hydraulics model 92 may determine a desired fluid friction to maintain the desired temperature at the location.

The hydraulics model 92 may determine a temperature profile along a wellbore 12. The hydraulics model 92 may determine changes to the temperature profile due to the adjusting.

Also described above is a method of maintaining a desired temperature at a location in a well. In one example, the method can include adjusting a density of a fluid 18 circulated through the well, thereby reducing a difference between an actual temperature at the location and the desired temperature.

The adjusting step can include adjusting a solids content of the fluid 18.

A hydraulics model 92 can determine a change in the fluid 18 density to effect an urging of the actual temperature at the location toward the desired temperature. The hydraulics model 92 can determine a desired pressure set point after the adjusting. The hydraulics model 92 may determine a desired fluid friction to maintain the desired temperature at the location.

Another method of maintaining a desired temperature at a location in a well can comprise adjusting fluid friction due to a fluid 18 being circulated through the well, thereby reducing a difference between an actual temperature at the location and the desired temperature.

The adjusting may be performed by adjusting a density of the fluid 18, by adjusting a flow rate of the fluid 18, and/or by adjusting a solids content of the fluid 18.

The method can include a hydraulics model 92 determining a change in the fluid friction to reduce the difference between the actual temperature and the desired temperature. The hydraulics model 92 may determine a desired fluid density and/or flow rate to maintain the desired temperature at the location.

A well system described above can include at least one sensor (e.g., sensors 54, 56, 60), an output of the sensor being used for determining a temperature at a location in a well, and a hydraulics model 92 which determines a desired change in fluid 18 circulation through the well, in response to the temperature at the location being different from a desired temperature at the location.

The hydraulics model 92 may determine a desired density of the fluid 18, a desired flow rate of the fluid 18, a desired solids content of the fluid 18, and/or a desired fluid friction due to the fluid 18 circulation through the well. The hydraulics model 92 may determine changes to a temperature profile due to an actual change in the fluid 18 circulation.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. For example, structures disclosed as being separately formed can, in other examples, be integrally formed and vice versa. Accordingly, the foregoing detailed description is to be clearly understood as being given by way of illustration and example only, the spirit and scope of the invention being limited solely by the appended claims and their equivalents.

What is claimed is:

1. A method of achieving a desired temperature of a bottom hole assembly in a well being drilled with drilling fluid having a density, a solids content, and a flow rate, the method comprising:

measuring a temperature of the bottom hole assembly;

determining whether to adjust any one or more of the density, the solids content, and the flow rate of the drilling fluid with a hydraulics model based on parameters including the desired temperature, the measured temperature, the density, the solids content, and the flow rate to achieve the desired temperature; and adjusting any one or more of the density, the solids content, and the flow rate of the drilling fluid based on the hydraulics model to achieve the desired temperature of the bottom hole assembly, while maintaining a desired pressure in the well.

2. The method of claim 1, wherein adjusting further comprises adjusting the solids content to reduce the difference between the desired temperature and the measured temperature at the bottom hole assembly.

3. The method of claim 1, wherein adjusting further comprises adjusting the fluid flow rate to reduce the difference between the desired temperature and the measured temperature at the bottom hole assembly.

4. The method of claim 1, further comprising determining a change in the solids content of the drilling fluid with the hydraulics model to adjust the measured temperature toward the desired temperature.

5. The method of claim 4, further comprising determining, with the hydraulics model, a desired pressure set point after the adjusting.

6. The method of claim 4, further comprising determining, with the hydraulics model, a desired annulus pressure set point to maintain the desired pressure in the well.

7. The method of claim 4, further comprising determining, with the hydraulics model, a desired drilling fluid height to maintain the desired pressure in the well.

8. The method of claim 4, further comprising determining, with the hydraulics model, a desired fluid friction to achieve the desired temperature of the bottom hole assembly.

9. The method of claim 4, further comprising determining, with the hydraulics model, a temperature profile along a wellbore.

10. The method of claim 9, further comprising determining, with the hydraulics model, changes to the temperature profile due to the adjusting.

11. A well system for a well, comprising:

a pump configured to circulate a drilling fluid having a density, a solids content, and a flow rate through the well;

a bottom hole assembly locatable in the well and comprising a sensor, wherein an output of the sensor permits determination of a temperature of the bottom hole assembly; and a hydraulics model configured to adjust any one or more of the density, the solids content, and the flow rate of the drilling fluid to achieve a desired temperature of the bottom hole assembly while maintaining a desired pressure in the well, wherein the hydraulics model is based on parameters including the desired temperature, the determined temperature, the density, the solids content, and the flow rate.

12. The system of claim 11, wherein the hydraulics model is configured to determine a desired density of the drilling fluid.

13. The system of claim 11, wherein the hydraulics model is configured to determine a desired flow rate of the drilling fluid through the well.

14. The system of claim 11, wherein the hydraulics model is configured to determine a desired solids content of the drilling fluid.

15. The system of claim 11, wherein the hydraulics model is configured to determine a desired fluid friction due to the drilling fluid circulation through the well.

16. The system of claim 11, wherein the hydraulics model is configured to determine a desired pressure set point.

17. The system of claim 11, wherein the hydraulics model is configured to determine a desired annulus pressure set point to maintain the desired pressure in the well.

18. The system of claim 11, wherein the hydraulics model is configured to determine a desired drilling fluid height to maintain the desired pressure in the well.

19. The system of claim 11, wherein the hydraulics model is configured to determine a desired drilling fluid density to achieve the desired temperature at the bottom hole assembly.

20. The system of claim 11, wherein the hydraulics model is configured to determine a desired flow rate of the drilling fluid to achieve the desired temperature at the bottom hole assembly.

21. The system of claim 11, wherein the hydraulics model is configured to determine a temperature profile along a wellbore of the well.

22. The system of claim 21, wherein the hydraulics model is configured to determine changes to the temperature profile due to an actual change in the drilling fluid circulation.

* * * * *